US008317116B2

(12) United States Patent
Dirk et al.

(10) Patent No.: US 8,317,116 B2
(45) Date of Patent: Nov. 27, 2012

(54) METHOD AND APPARATUS FOR PROCESSING A SIZED ORE FEED

(75) Inventors: Terry Dirk, Fort McMurray (CA); Paul Frederick MacDougall, Fort McMurray (CA)

(73) Assignee: Suncor Energy Inc., Calgary, AB (CA)

( * ) Notice: Subject to any disclaimer, the term of this patent is extended or adjusted under 35 U.S.C. 154(b) by 105 days.

(21) Appl. No.: 12/242,642

(22) Filed: Sep. 30, 2008

(65) Prior Publication Data

US 2009/0133987 A1 May 28, 2009

Related U.S. Application Data

(63) Continuation-in-part of application No. 11/938,189, filed on Nov. 9, 2007.

(51) Int. Cl.
*B02C 21/02* (2006.01)

(52) U.S. Cl. ..... 241/30; 241/101.5

(58) Field of Classification Search ..... 241/27, 241/101.5, 30, 186.35, 223
See application file for complete search history.

(56) References Cited

U.S. PATENT DOCUMENTS

| | | | | |
|---|---|---|---|---|
| 3,358,855 | A | 12/1967 | Carlton et al. | 214/10 |
| 3,402,896 | A | 9/1968 | Daman | 241/38 |
| 4,103,972 | A | 8/1978 | Kochanowsky | 299/18 |
| 4,206,840 | A | 6/1980 | Hanson et al. | 198/301 |
| 4,212,353 | A | 7/1980 | Hall | 166/303 |
| 4,489,818 | A | 12/1984 | Franke et al. | 198/311 |
| 4,505,516 | A | 3/1985 | Shelton | 299/2 |

(Continued)

FOREIGN PATENT DOCUMENTS

| | | |
|---|---|---|
| CA | 1068633 | 12/1979 |

(Continued)

OTHER PUBLICATIONS

PCT International Search Report (ISR) and Written Opinion for App. No. PCT/CA2009/001367 ( WO20100372215).

(Continued)

*Primary Examiner* — Mark Rosenbaum
(74) *Attorney, Agent, or Firm* — Knobbe, Martens, Olson & Bear, LLP

(57) ABSTRACT

A method and process line apparatus for processing a sized ore feed excavated from an ore deposit is disclosed. The method involves disposing a processing apparatus in a processing apparatus position relative to the ore deposit, and disposing a first mobile conveyor to receive a sized ore feed at a receiving location located along a length of the first mobile conveyor. The first mobile conveyor is operable to convey the sized ore from the receiving location to a discharge end of the first mobile conveyor. The method also involves disposing a second mobile conveyor to receive the sized ore from the discharge end of the first mobile conveyor at a transfer location along a length of the second mobile conveyor and to convey the sized ore from the transfer location to the processing apparatus. The first and second mobile conveyors are oriented at an operational angle between a length of the first mobile conveyor and a length of the second mobile conveyor. The method further involves moving at least one of the first and second mobile conveyors to vary at least one of the operational angle and the transfer location to permit successive portions of the ore deposit within operational reach of the receiving location to be received for conveying along the first and second mobile conveyors to the processing apparatus while the processing apparatus is located in the processing apparatus position.

33 Claims, 8 Drawing Sheets

U.S. PATENT DOCUMENTS

| | | | | |
|---|---|---|---|---|
| 4,505,811 | A | 3/1985 | Griffiths et al. | 209/13 |
| 4,512,956 | A | 4/1985 | Robinson et al. | 422/270 |
| 4,519,899 | A | 5/1985 | Oertle et al. | 208/179 |
| 4,585,180 | A | 4/1986 | Potts | 241/186 |
| 4,733,828 | A | 3/1988 | Potts | 241/236 |
| 4,763,845 | A | 8/1988 | Guggenheimer et al. | 241/101.7 |
| 4,781,331 | A | 11/1988 | Potts | 241/236 |
| 4,799,627 | A | 1/1989 | Potts | 241/236 |
| 4,859,317 | A | 8/1989 | Shelfantook et al. | 208/391 |
| 5,161,744 | A | 11/1992 | Maurer et al. | 241/101.7 |
| 5,234,094 | A | 8/1993 | Weyermann et al. | 198/303 |
| 5,316,664 | A | 5/1994 | Gregoli et al. | 208/390 |
| 5,377,810 | A | 1/1995 | Lehtonen et al. | 198/303 |
| 5,441,206 | A | 8/1995 | Schade et al. | 241/81 |
| 5,480,566 | A | 1/1996 | Strand | 210/772 |
| 5,723,042 | A | 3/1998 | Strand et al. | 208/391 |
| 5,772,127 | A | 6/1998 | Maciejewski et al. | 241/21 |
| 5,954,277 | A | 9/1999 | Cymerman et al. | 241/21 |
| 6,074,549 | A | 6/2000 | Bacon Cochrane et al. | 208/391 |
| 6,155,400 | A * | 12/2000 | Daigh et al. | 198/301 |
| 6,283,277 | B1 | 9/2001 | Smith et al. | 198/861.2 |
| 6,322,327 | B1 | 11/2001 | Dawson et al. | 417/198 |
| 6,336,684 | B1 | 1/2002 | Turner | 299/1.9 |
| 6,450,775 | B1 | 9/2002 | Hutchinson et al. | 417/198 |
| 6,527,960 | B1 | 3/2003 | Bacon et al. | 210/741 |
| 6,821,060 | B2 | 11/2004 | McTurk et al. | 406/137 |
| 7,013,937 | B2 | 3/2006 | Potts | 141/387 |
| 7,651,042 | B2 | 1/2010 | Bjornson et al. | 241/62 |
| 8,016,216 | B2 | 9/2011 | Bjornson et al. | 241/21 |
| 8,025,341 | B2 | 9/2011 | Bjornson et al. | 299/18 |
| 8,096,425 | B2 | 1/2012 | Bjornson et al. | 210/512.2 |
| 2001/0001434 | A1 | 5/2001 | Daigh et al. | 198/301 |
| 2004/0251731 | A1 | 12/2004 | Potts | 299/18 |
| 2004/0262980 | A1 | 12/2004 | Watson | 299/8 |
| 2005/0134102 | A1 | 6/2005 | Cymerman et al. | 299/7 |
| 2005/0173726 | A1 | 8/2005 | Potts | 257/134 |
| 2005/0183930 | A1 | 8/2005 | Bernard et al. | 198/508 |
| 2006/0091249 | A1 | 5/2006 | Potts | 241/236 |
| 2008/0149542 | A1 | 6/2008 | Bjornson et al. | 210/137 |
| 2008/0173572 | A1 | 7/2008 | Bjornson et al. | 208/391 |

FOREIGN PATENT DOCUMENTS

| | | |
|---|---|---|
| CA | 1103184 | 6/1981 |
| CA | 1153347 | 6/1983 |
| CA | 1163257 | 6/1984 |
| CA | 1193586 | 9/1985 |
| CA | 1231692 | 1/1988 |
| CA | 1256045 | 6/1989 |
| CA | 1266261 | 2/1990 |
| CA | 1267860 | 4/1990 |
| CA | 1269945 | 6/1990 |
| CA | 1277941 | 12/1990 |
| CA | 2000984 | 4/1991 |
| CA | 2060780 | 8/1992 |
| CA | 1309050 | 10/1992 |
| CA | 2092121 | 3/1993 |
| CA | 2088227 | 4/1994 |
| CA | 2029795 | 5/1996 |
| CA | 2294860 | 12/1998 |
| CA | 2217623 | 4/1999 |
| CA | 2249679 | 4/1999 |
| CA | 2195604 | 11/1999 |
| CA | 2246841 | 3/2000 |
| CA | 2358805 | 10/2001 |
| CA | 2315596 | 2/2002 |
| CA | 2332207 | 2/2002 |
| CA | 2259245 | 10/2002 |
| CA | 2222667 | 11/2002 |
| CA | 2227667 | 11/2002 |
| CA | 2235938 | 4/2003 |
| CA | 2431648 | 6/2003 |
| CA | 2498862 | 10/2003 |
| CA | 2518040 | 12/2003 |
| CA | 2522514 | 4/2004 |
| CA | 2469326 | 5/2004 |
| CA | 2440312 | 4/2005 |
| CA | 2440311 | 5/2005 |
| CA | 2548370 | 5/2005 |
| CA | 2548371 | 5/2005 |
| CA | 2453697 | 6/2005 |
| CA | 2558059 | 11/2005 |
| CA | 2476194 | 1/2006 |
| CA | 2499840 | 9/2006 |
| CA | 2499846 | 9/2006 |
| CA | 2520821 | 3/2007 |
| CA | 2526336 | 5/2007 |
| CA | 2567644 | 5/2007 |
| DE | 2834987 | 2/1980 |
| DE | 3936681 | 5/1990 |
| EP | 0167178 | 1/1986 |
| GB | 1090689 | 11/1967 |
| GB | 0401933-1 | 1/2005 |
| GB | 0406802-9 | 1/2005 |
| WO | WO 83/00318 | 2/1983 |
| WO | WO 83/02071 | 6/1983 |
| WO | WO 83/03062 | 9/1983 |
| WO | WO 83/03444 | 10/1983 |
| WO | WO 98/58739 | 12/1998 |
| WO | WO 99/54049 | 10/1999 |
| WO | WO 00/10896 | 3/2000 |
| WO | WO 00/35585 | 6/2000 |
| WO | WO 02/092231 | 11/2002 |
| WO | WO 03/006165 | 1/2003 |
| WO | WO 03/074394 | 12/2003 |
| WO | WO 2004/094061 | 4/2004 |
| WO | WO2004/060819 | 7/2004 |
| WO | WO 2005/046874 | 5/2005 |
| WO | WO 2005/046875 | 5/2005 |
| WO | WO 2005/000454 | 6/2005 |
| WO | WO 2005/072877 | 11/2005 |
| WO | WO 2006/035209 | 6/2006 |

OTHER PUBLICATIONS

National Energy Board, Canada's Oil Sands: A Supply and Market Outlook to 2015, An Energy Market Assessment Oct. 2000.

Rimmer, Gregoli and Yildlrim, "Hydrocyclone-based Process for Rejecting Solids from Oil Sands at the Mine Site While Retaining Bitumen for Transportation to a Processing Plant"; Suncor Extraction 3rd f1 pp. 93-100, Paper delivered on Monday Apr. 5, 1993 at a conference in Alberta, Canada entitled "Oil Sands-Our Petroleum Future".

Protest to CA 2358805 Application.

"Oil Sands, Our Petroleum Future" Conference held at Edmonton Convention Centre, Edmonton, Alberta, Canada Apr. 4-7, 1993.

Jon Harding, "Cost-Saving Moves into High Gear" article in Financial Post, Apr. 4, 2006.

Excerpts from "Information Package for Mobile Crushing Plants (MCP)", Krupp Canada.

Jonah, Ken; "Syncrude's Mine Production Planning", Mine Planning and Equipment, Singhal (ed.) pp. 443-456, 1988 Balkema, Rotterdam.

Doucet et al. "Drilling and Blasting in Tarsand", Suncor Oil Sands Group, Nov. 7 and 8, 1985.

De Malherbe, et al. "Synthetic Crude from Oil Sands", VDI-Verlag GmbH, Dusseldorf 1983, vol. 3, No. 8, pp. 20-21.

Coward, Julian, seminar material used as class handout, University of Alberta, Mar. 20, 2000.

Office Action dated May 23, 2008 for U.S. Appl. No. 11/558,340.

Restriction Requirement dated Dec. 2, 2008 for U.S. Appl. No. 11/558,340.

Office Action dated Apr. 29, 2009 for U.S. Appl. No. 11/558,340.

Office Action dated Nov. 6, 2009—Notice of Non-Compliant Amendment.

Office Action dated Mar 18, 2010 for U.S. Appl. No. 11/558,340.

Office Action dated Nov. 24, 2010 for U.S. Appl. No. 11/558,340.

Notice of Allowance dated Feb. 7, 2011 for U.S. Appl. No. 11/558,340.

Restriction Requirement dated Aug. 25, 2009 for U.S. Appl. No. 11/938,189.
Office Action dated Mar 17, 2010 for U.S. Appl. No. 11/938,189.
Office Action dated Nov. 9, 2010 for U.S. Appl. No. 11/938,189.
Notice of Allowance dated Feb. 4, 2011 for U.S. Appl. No. 11/938,189.
Office Action dated Aug. 28, 2008 for U.S. Appl. No. 11/558,303—Restriction Requirement.
Office Action dated Nov. 12, 2008 for U.S. Appl. No. 11/558,303.
Notice of Allowance dated Sep. 14, 2009 for U.S. Appl. No. 11/558,303.
Restriction Requirement dated Feb. 8, 2011 for U.S. Appl. No. 11/938,175.
Office action dated May 23, 2011 for U.S. Appl. No. 11/938,175.

* cited by examiner

METHOD AND APPARATUS FOR PROCESSING A SIZED ORE FEED

CROSS-REFERENCE TO RELATED APPLICATIONS

This application is a continuation-in-part of U.S. patent application Ser. No. 11/938,189 entitled "METHOD AND APPARATUS FOR CREATING A SLURRY" filed on Nov. 9, 2007.

INCORPORATION BY REFERENCE

This application hereby incorporates by reference U.S. patent application Ser. No. 11/558,303 entitled "METHOD AND APPARATUS FOR CREATING A SLURRY" filed on Nov. 9, 2006 and Canadian Patent Application No. 2,526,336 filed on Nov. 9, 2005 in their entireties.

BACKGROUND

1. Field of the Invention

This invention relates generally to mining and more particularly to processing a sized ore feed.

2. Description of Related Art

Surface mining operations are generally employed to excavate an ore deposit that is found near the surface. Such ore deposits are usually covered by an overburden of rock, soil, and/or plant matter, which may be removed prior to commencing mining operations. The remaining ore deposit may then be excavated and transported to a plant for processing to remove commercially useful products. For example, the ore deposit may comprise an oil sand deposit from which hydrocarbon products may be extracted.

In the example of an oil sand ore deposit, such as the Northern Alberta Tar Sands, the ore deposit comprises about 70 to about 90 percent by weight of mineral solids including sand and clay, about 1 to about 10 percent by weight of water, and a bitumen or oil film. The bitumen may be present in amounts ranging from a trace amount up to as much as 20 percent by weight. Consequently, since oil sand ore deposits comprises a relatively small percentage by weight of bitumen, it is generally more efficient and cost effective to at least partially separate the bitumen from the ore as soon as possible after excavation, since significant energy costs are incurred in transporting the ore over long distances.

In commonly owned Canadian Patent Application No. 2,567,644, a process line for mining an oil sands ore body is disclosed. The process line includes an excavator for mining oil sands ore, a comminutor for receiving mined ore from the excavator and comminuting the mined ore to conveyable size and transferring the comminuted ore to a mobile conveyor for transporting the comminuted ore. The comminutor supplies conveyable ore to the mobile conveyor, and the mobile conveyor is periodically moved in an arc about a discharge end to locate another portion of the ore body within operational reach of the mobile conveyor until substantially all of the ore body within operational reach of the conveyor has been mined. In one disclosed embodiment the ore is transported to a mobile slurry facility located proximate a mine face of an oil sand deposit. Operation of the disclosed process line requires that the overburden be removed, either prior to commencing excavation or as the conveyor advances in the operational arc. Following mining of the ore deposit, the slurry facility may be relocated to a subsequent mine face for excavation of a subsequent portion of the ore body. Accordingly, the disclosed process line facilitates successively mining generally circular sectors of the ore deposit.

SUMMARY

One embodiment provides a method for processing a sized ore feed excavated from an ore deposit. The method involves disposing a processing apparatus in a processing apparatus position relative to the ore deposit, and disposing a first mobile conveyor to receive a sized ore feed at a receiving location located along a length of the first mobile conveyor. The first mobile conveyor is operable to convey the sized ore from the receiving location to a discharge end of the first mobile conveyor. The method also involves disposing a second mobile conveyor to receive the sized ore from the discharge end of the first mobile conveyor at a transfer location along a length of the second mobile conveyor and to convey the sized ore from the transfer location to the processing apparatus. The first and second mobile conveyors are oriented at an operational angle between a length of the first mobile conveyor and a length of the second mobile conveyor. The method further involves moving at least one of the first and second mobile conveyors to vary at least one of the operational angle and the transfer location to permit successive portions of the ore deposit within operational reach of the receiving location to be received for conveying along the first and second mobile conveyors to the processing apparatus while the processing apparatus is located in the processing apparatus position.

The ore deposit may include at least one portion within operational reach of the receiving location that is not to be excavated and moving at least one of the first and second mobile conveyors may involve varying at least one of the operational angle and the transfer location to move the receiving location around the at least one portion that is not to be excavated.

Receiving the sized ore feed at the receiving location may involve receiving the sized ore feed proximate at least one of a plurality of receiving locations along the length of the first mobile conveyor.

Receiving the sized ore feed at the at least one of the plurality of receiving locations may involve receiving the sized ore feed at a hopper mounted for movement on a track extending along at least a portion of the length of the first mobile conveyor.

Receiving the sized ore feed may involve receiving ore from an excavator and comminuting the ore to produce the sized ore feed.

Receiving the ore from the excavator may involve receiving the ore in a load carrying container and transporting the ore to a comminutor for comminuting the ore.

Disposing the processing apparatus may involve disposing the processing apparatus at an angle to a mine face of the ore deposit to provide clearance between the second mobile conveyor and the processing apparatus when moving the second mobile conveyor.

In a first operational stage disposing the first mobile conveyor may involve disposing the first mobile conveyor to position the receiving location of the first mobile conveyor at a distal mine face location with respect to the processing apparatus position, disposing the second mobile conveyor may involve causing the second mobile conveyor to be disposed to discharge the sized ore into a feeder of the processing apparatus, and moving at least one of the first and second mobile conveyors may involve causing the second mobile conveyor to successively move toward the mine face about the feeder while causing the first mobile conveyor to progressively advance into the ore deposit while excavating a first portion of the ore deposit within operational reach of the receiving location.

Disposing the second mobile conveyor to receive the sized ore from the discharge end of the first mobile conveyor may involve disposing the second mobile conveyor to receive the sized ore at a transfer location proximate an end of the second mobile conveyor that may be distally located with respect to the discharge end of the second mobile conveyor.

In a second operational stage disposing the second mobile conveyor may involve causing the second mobile conveyor to be disposed generally parallel to the mine face, and moving the at least one of the first and second mobile conveyors may involve causing the first mobile conveyor to be laterally translated while successively moving the transfer location along the second mobile conveyor toward the feeder of the processing apparatus while maintaining the operational angle substantially constant to permit excavation of a second portion of the ore deposit within operational reach of the receiving location.

Maintaining the operational angle substantially constant may involve maintaining an operational angle of about 90 degrees.

In a third operational stage disposing the second mobile conveyor may involve causing the second mobile conveyor to be moved to position the transfer location on an opposite side of the feeder of the processing apparatus, and moving the at least one of the first and second mobile conveyors may involve moving the first mobile conveyor to place the discharge end of the first mobile conveyor at the transfer location, and causing the first mobile conveyor to be laterally translated while successively moving the transfer location along the second mobile conveyor away from the feeder of the processing apparatus while maintaining the operational angle substantially constant to permit excavation of a third portion of the ore deposit within operational reach of the receiving location.

In a fourth operational stage moving the at least one of the first and second mobile conveyors may involve causing the first and second mobile conveyors to be disposed at an operational angle of about 180 degrees such that the first and second mobile conveyors may be generally in-line with each other to permit excavation of distally located portions of the ore deposit within operational reach of the receiving location.

Moving at least one of the first and second mobile conveyors may involve moving both the first mobile conveyor and the second mobile conveyor while varying the operational angle to permit excavation along a generally linear mine face portion of the ore deposit.

The processing apparatus position may be a first processing apparatus position and the method may further involve, on completion of excavation of the successive portions of the ore deposit within operational reach of the receiving location, relocating the processing apparatus to a second processing apparatus position to permit excavation of further portions of the ore deposit while the processing apparatus may be located in the second processing apparatus position.

In accordance with another aspect of the invention there is provided a process line apparatus for processing a sized ore feed excavated from an ore deposit. The apparatus includes a processing apparatus disposed in a processing apparatus position relative to the ore deposit, and a first mobile conveyor disposed to receive a sized ore feed at a receiving location located along a length of the first mobile conveyor. The first mobile conveyor is operable to convey the sized ore from the receiving location to a discharge end of the first mobile conveyor. The apparatus also includes a second mobile conveyor disposed to receive the sized ore from the discharge end of the first mobile conveyor at a transfer location along a length of the second mobile conveyor and to convey the sized ore from the transfer location to the processing apparatus. The first and second mobile conveyors are oriented at an operational angle between a length of the first mobile conveyor and a length of the second mobile conveyor. The apparatus also includes provisions for moving at least one of the first and second mobile conveyors to vary at least one of the operational angle and the transfer location to permit successive portions of the ore deposit within operational reach of the receiving location to be to be excavated and received for conveying along the first and second mobile conveyors to the processing apparatus while the processing apparatus is located in the processing apparatus position.

The ore deposit may include at least one portion within operational reach of the receiving location that is not to be excavated and the provisions for moving at least one of the first and second mobile conveyors may include provisions for varying at least one of the operational angle and the transfer location to move the receiving location around the at least one portion that is not to be excavated.

The receiving location may include at least one of a plurality of receiving locations along the length of the first mobile conveyor.

The first mobile conveyor may be operably configured to receive the sized ore feed at a hopper mounted for movement on a track extending along at least a portion of the length of the first mobile conveyor.

The apparatus may include an excavator for excavating ore from the ore deposit, and a comminutor for receiving the excavated ore from the excavator and comminuting the ore to produce the sized ore feed.

The apparatus may include a load carrying container for transporting the ore between the excavator and the comminutor.

The processing apparatus may be disposed at an angle to a mine face of the ore deposit to provide clearance between the second mobile conveyor and the processing apparatus when moving the second mobile conveyor.

The first mobile conveyor and the second mobile conveyor each may include a plurality of conveyor sections, each conveyor section including provisions for moving the conveyor section, and alignment provisions for aligning the plurality of conveyor sections.

The provisions for moving at least one of the first and second mobile conveyors may include provisions for moving both the first mobile conveyor and the second mobile conveyor while varying the operational angle to permit excavation along a generally linear mine face portion of the ore deposit.

Another embodiment provides a process line apparatus for processing a sized ore feed excavated from an ore deposit. The apparatus includes a processing apparatus disposed in a processing apparatus position relative to the ore deposit, and a first mobile conveyor disposed to receive a sized ore feed at a receiving location located along a length of the first mobile conveyor, the first mobile conveyor being operable to convey the sized ore from the receiving location to a discharge end of the first mobile conveyor. The apparatus also includes a second mobile conveyor disposed to receive the sized ore from the discharge end of the first mobile conveyor at a transfer location along a length of the second mobile conveyor and to convey the sized ore from the transfer location to the processing apparatus. The first and second mobile conveyors are oriented at an operational angle between a length of the first mobile conveyor and a length of the second mobile conveyor, and the first mobile conveyor and the second mobile conveyor are operably configured to move to vary at least one of the operational angle and the transfer location to permit successive portions of the ore deposit within operational reach of the receiving location to be excavated and received for conveying along the first and second mobile conveyors to the processing apparatus while the processing apparatus is located in the processing apparatus position.

The ore deposit may include at least one portion within operational reach of the receiving location that is not to be excavated and the first and second mobile conveyors may be operably configured to vary at least one of the operational angle and the transfer location to move the receiving location around the at least one portion that is not to be excavated.

The receiving location may include at least one of a plurality of receiving locations along the length of the first mobile conveyor.

The first mobile conveyor may be operably configured to receive the sized ore feed at a hopper mounted for movement on a track extending along at least a portion of the length of the first mobile conveyor.

The apparatus may include an excavator for excavating ore from the ore deposit, and a comminutor for receiving the excavated ore from the excavator and comminuting the ore to produce the sized ore feed.

The apparatus may include a load carrying container for transporting the ore between the excavator and the comminutor.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention.

DETAILED DESCRIPTION

Process Line

Figure 1:
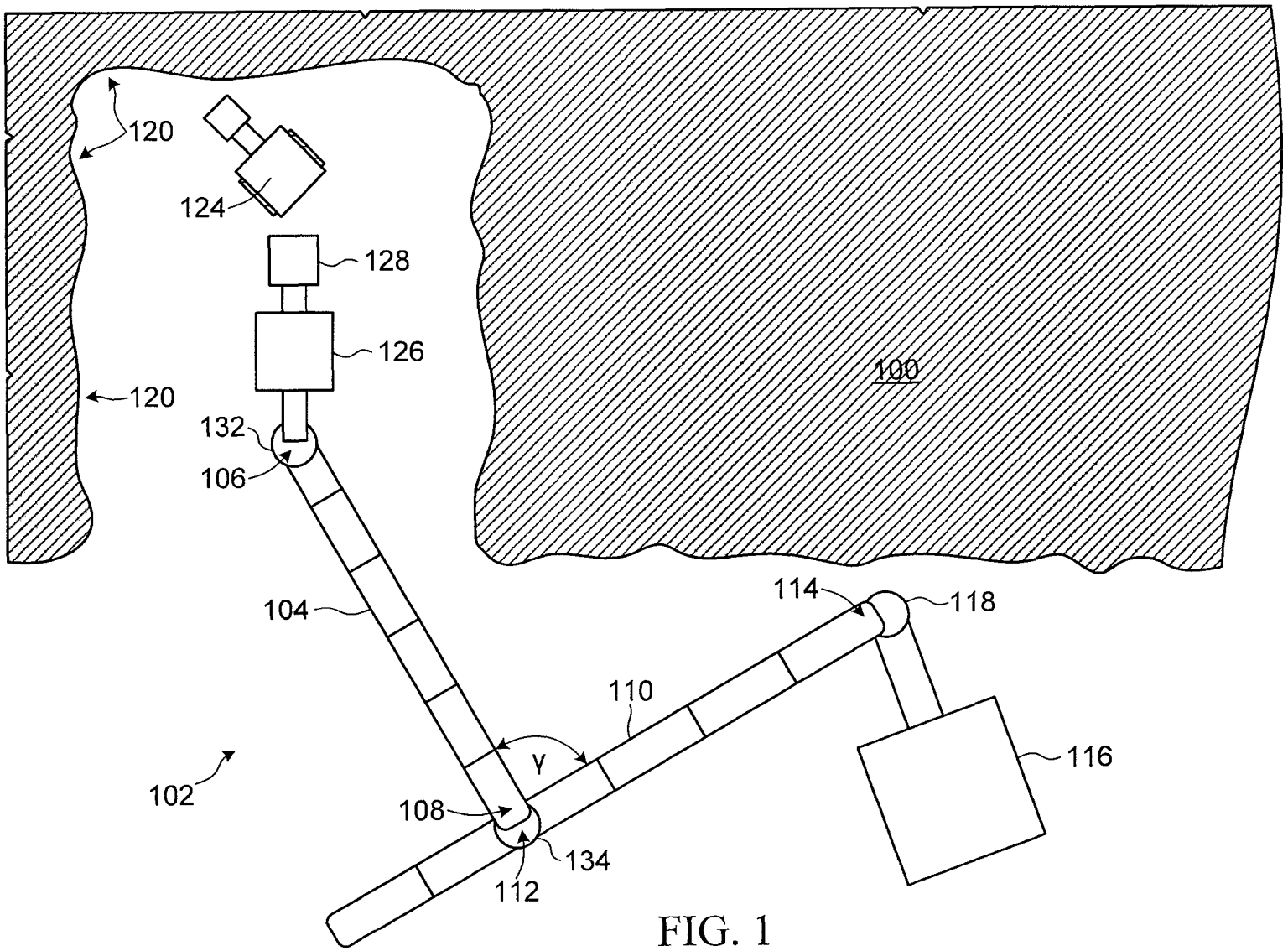
FIG. 1 is a plan view of a process line apparatus for processing sized ore in accordance with a first embodiment of the invention.

Referring to FIG. 1, a process line apparatus for processing sized ore excavated from an ore deposit 100 is shown generally at 102. The apparatus 102 includes a processing apparatus 116 located in a processing apparatus position relative to the ore deposit 100.

The apparatus 102 also includes a first mobile conveyor 104 disposed to receive a sized ore feed at a receiving location 106 located along a length of the first mobile conveyor. The first mobile conveyor 104 is operable to convey the sized ore from the receiving location 106 to a discharge end 108 of the first mobile conveyor.

The apparatus 102 further includes a second mobile conveyor 110 disposed to receive the sized ore from the discharge end 108 of the first mobile conveyor 104 at a transfer location 112 along a length of the second mobile conveyor. The second mobile conveyor 110 conveys the sized ore from the transfer location 112 to the processing apparatus 116.

The first and second mobile conveyors 104 and 110 are oriented at an operational angle $\gamma$ between the length of the first mobile conveyor and the length of the second mobile conveyor. The first mobile conveyor 104 and the second mobile conveyor 108 are also operably configured to move to vary the operational angle $\gamma$ and/or the transfer location 112 to permit successive portions of the ore deposit within operational reach of the receiving location to be to be excavated and received for conveying along the first and second mobile conveyors to the processing apparatus 116.

In the embodiment shown in FIG. 1 the receiving location 106 comprises a hopper 132 for receiving the sized ore feed from the comminutor 126 and the transfer location 112 comprises a hopper 134 for receiving sized ore from the discharge end 108 of the first mobile conveyor.

In the embodiment shown, the apparatus 102 also includes an excavator 124 for excavating the ore from the mine face 120, and a comminutor 126 for producing the sized ore feed. The comminutor 126 generally crushes larger chunks of the excavated ore to produce an ore feed having a maximum portion size that is conveyable by the first and second mobile conveyors 104 and 110.

In one embodiment the ore deposit 100 comprises a bituminous ore, having a substantial portion of mineral solids such as sand and clay, water, and a bitumen and/or oil film. Bituminous ore may comprise up to about 20 percent bitumen by weight, and processing the ore involves separating the bitumen from the sand, clay, water, and other trace constituents. Processing of bituminous ore may involve a plurality of processing steps such as producing a bitumen ore slurry. In other embodiments the ore deposit 100 may comprise other minerals and/or constituents that are to be extracted from ore excavated during in an open pit or strip mining operation, for example. Alternatively, the process line apparatus 102 may be used to remove an overburden layer overlying an ore deposit.

Figure 2:
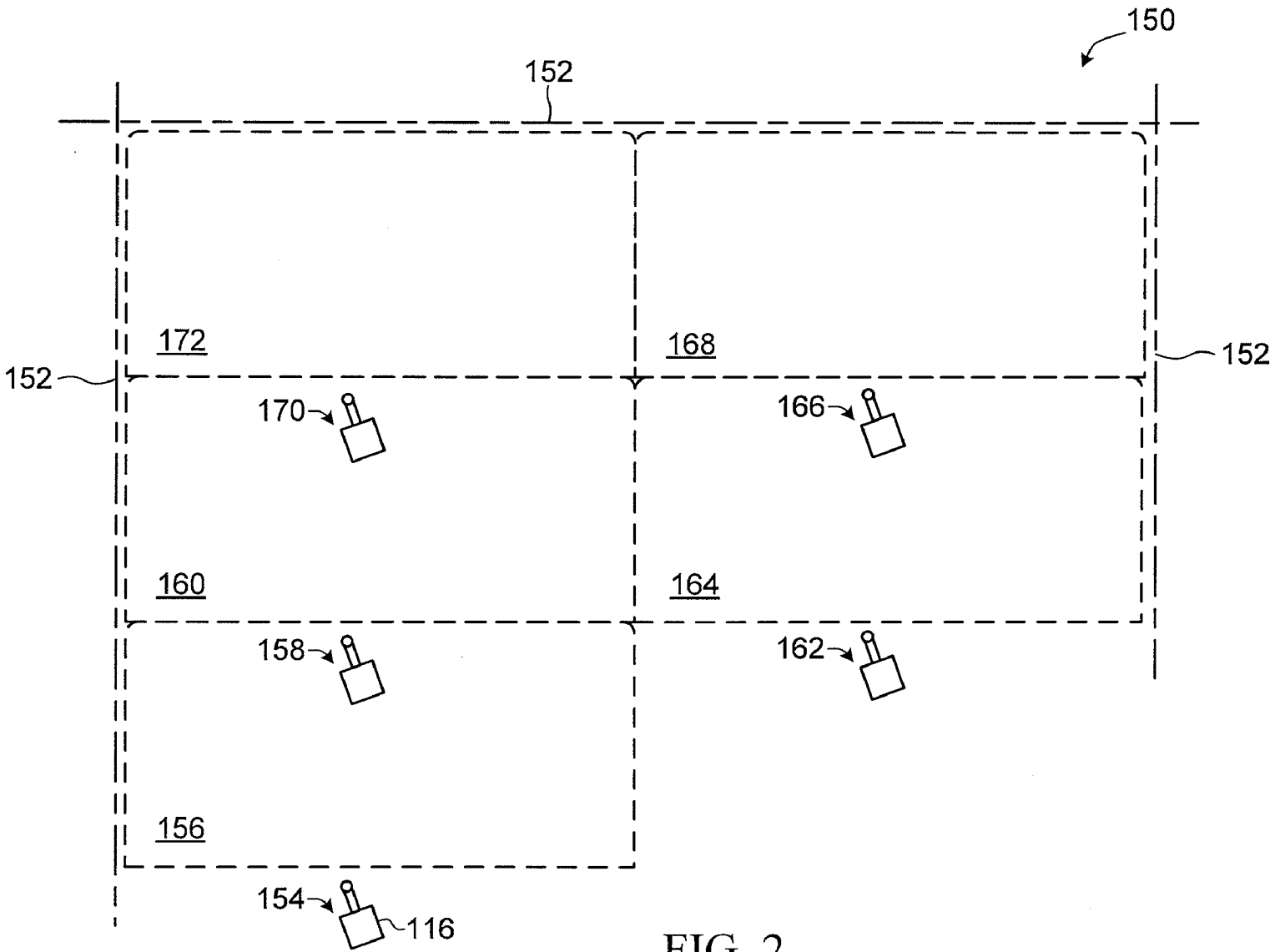
FIG. 2 is a schematic view of a mine site.

Referring to FIG. 2, a schematic view of a mine site in accordance with one embodiment of the invention is shown generally at 150. The mine site 150 has boundaries 152 beyond which it is not permitted or not desired to excavate the ore deposit. In this embodiment, the processing apparatus 116 is initially located at a first processing apparatus position 154 for excavating a first ore section 156 of the ore deposit in mine site 150. When the first section 156 has been excavated, the processing apparatus 116 is relocated to a second processing apparatus position 158 for mining a second section 160 of the ore deposit. Subsequent sections 164, 168, and 172 are then excavated by relocating the processing apparatus 116 to respective processing apparatus positions 162, 166, and 170. Each subsequent processing apparatus position 154, 158, 162, 166, and 170 provides access to a section of the ore deposit such that the entire ore deposit between the boundaries 152 of the mine site 150 may be excavated and processed. Each time the processing apparatus is relocated, the first and second mobile conveyors 104 and 110, the comminutor 126, and the excavator 124 are also moved to excavate subsequent sections 160, 164, 168, and 172. In this embodiment the sections 156, 160, 164, 168, and 172 are generally of rectangular shape but in other embodiments the sections may be otherwise shaped or irregularly shaped. As described later herein, the sections 156, 160, 164, 168, and 172 may also include some portions (not shown in FIG. 2) that comprise low grade ore or obstacles that it is not desired to excavate.

First and Second Mobile Conveyors

Figure 3:
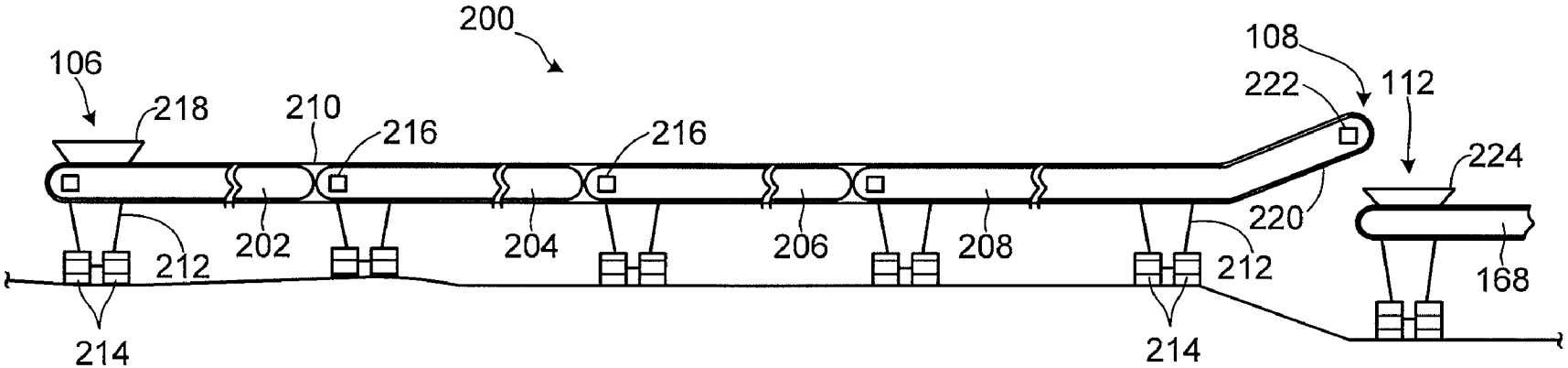
FIG. 3 is a side view of a mobile conveyor used in the process line apparatus shown in FIG. 1.

Referring to FIG. 3, an exemplary mobile conveyor in accordance with one embodiment of the invention is shown at 200. The mobile conveyor 200 includes a plurality of conveyor sections, including a first conveyor section 202, a plurality of intermediate conveyor sections 204 and 206, and a discharge conveyor section 208. The conveyor sections 202-208 are connected together end-to-end by pivot joints (not shown) and the sections support a continuous conveyor belt 210 for conveying the sized ore along the mobile conveyor 200.

Each conveyor section 202-208 includes at least one support 212 having crawler tracks 214 for moving the conveyor section. In this embodiment dual tracks 214 are provided facilitating movement of the conveyor sections in both transverse and longitudinal directions. The dual tracks 114 have the advantage of providing additional stability when it is desired to move the mobile conveyor 200 in the longitudinal direction.

In general the supports 212 and/or crawler tracks 214 may be independently height adjustable to accommodate changes in terrain height between conveyor sections 202-208. In the embodiment shown each conveyor section 202-208 includes an alignment gauge 216 for producing an alignment signal representing a misalignment condition between adjacent conveyor sections. The alignment gauge 216 produces signals representing lateral and/or height misalignment conditions between adjacent conveyor sections. The alignment gauge 216 may include a string pot (otherwise known as a cable extension transducer), for example.

The mobile conveyor 200 also includes a hopper 218, which may act as the receiving location 106, for example. The hopper 218 may be mounted for movement along a track (not shown) extending at least partway along the length of the mobile conveyor 200, to permit the receiving location 106 to be successively disposed at different locations along the mobile conveyor as required. Alternatively the conveyor 200 may be configured to provide a plurality of spaced apart locations at which the hopper may be located. In other embodiments, an additional hopper (not shown) may be included to permit sized ore to be simultaneously receiving at more than one receiving location.

In this embodiment the discharge conveyor section 208 includes an upwardly inclined conveyor portion 220 that acts as the discharge end 108. The discharge conveyor section 208 also includes an alignment sensor 222 that produces a signal for monitoring a location of the discharge end 108 with respect to a receiving location (such as a hopper 224 located on another conveyor section 168). The alignment sensor 222 produces a feedback signal for controlling the movement of the crawler tracks 214 on the discharge conveyor section 208 by monitoring the relative location of the discharge end 108 with respect to the hopper 224. The alignment sensor 222 may be an optical sensor, for example.

Generally, the mobile conveyor 200 also includes a controller (not shown) for activating the crawler tracks 214 in response to the alignment signals produced by the alignment gauges 216 and the feedback signal produced by the alignment sensor 222. In operation, the controller produces control signals for driving the crawler tracks 214 and the supports 212 to maintain the conveyor sections 202-208 in a generally straight line condition with the discharge end 108 aligned over the hopper 224. The mobile conveyor 200 may be moved about the discharge end 108 by moving the first conveyor section 202, thereby causing the conveyor sections 204, 206, and 208 to subsequently move to maintain the conveyor 200 in a straight line. Should the conveyor be required to move over uneven terrain, the controller may also produce height adjustment signals in response to the alignment signals produced by the alignment gauges 216 to cause the supports 212 to be adjusted to maintain the conveyor sections 202-208 in a generally level condition. The mobile conveyor 200 may also be laterally translated and/or longitudinally repositioned by causing each of the conveyor sections 202-208 to be moved substantially in the same direction and by the same amount.

By using conveyor sections 202-208 as modular units, the first and second mobile conveyors 104 and 110 may be easily assembled as required for excavating a particular ore deposit 100 and by adding one or more conveyor sections, may be extended to provide a greater operational reach, if required.

Suitable mobile and/or portable conveyor sections are manufactured by FLSmidth RAHCO Inc. of Spokane, Wash., USA and FAM of Magdeburg, Germany.

Processing Apparatus

Figure 4:
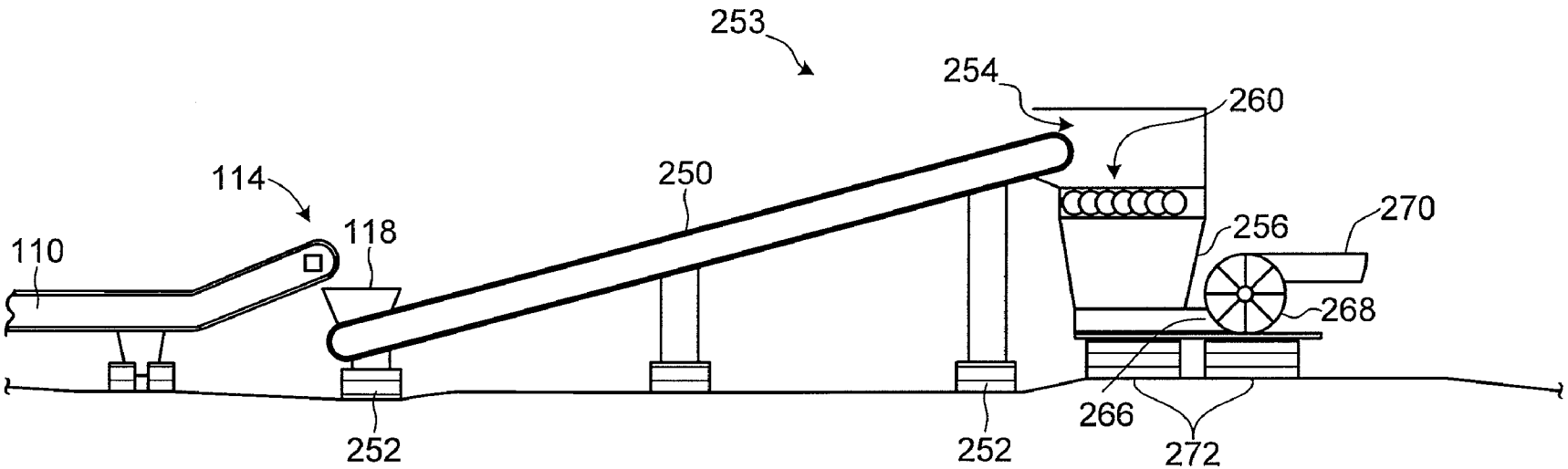
FIG. 4 is a side view of an exemplary processing apparatus used in the process line apparatus shown in FIG. 1.

Referring to FIG. 4, an exemplary embodiment of a slurry processing apparatus for processing a bituminous ore is shown at 253. The slurry apparatus 253 includes a slurry box 256 having an inlet chute 254. The slurry apparatus 253 also includes a transfer conveyor 250 and a hopper 118, which together act as a feeder for the slurry apparatus 253. The hopper 118 is located to receive sized ore from the discharge end 114 of the second mobile conveyor 110 and the transfer conveyor 250 conveys the sized ore to the inlet chute 254 of the slurry box 256. In this embodiment the slurry box 256 includes a sizing roller screen 260 such as that described in commonly owned Canadian Patent Application No. 2,476,194 entitled "Sizing Roller Screen Ore Processing." The sizing roller screen 260 screens and crushes the ore into a convenient size for producing the slurry.

In operation, hot water is generally introduced at the inlet chute 254 and at the roller screen 260. The hot water reduces ore buildup in the inlet chute 254 and the roller screen 260. In some embodiments further additives and/or cold water may be added as required. The combination of ore, water, and other additives produces a slurry which is accumulated in the slurry box 256. The slurry box 256 may be dimensioned such that, for an average ore feed rate through the inlet chute 254, the slurry retention time in the slurry box is approximately one minute. The slurry box 256 also includes an outlet 266 in communication with a hydro-transport pump 268. The hydro-transport pump 268 is in communication with a hydro-transport pipeline 270, and pumps bitumen slurry from the slurry box 256 through the hydro-transport pipeline to a plant (not shown) for further processing of the bitumen slurry.

In the embodiment shown, the slurry apparatus 253 also includes crawler tracks 272 on the slurry box 256, and crawler tracks 252 on the transfer conveyor 250 for relocating the slurry apparatus to subsequent processing apparatus positions 154, 158, 162, 166, and 170 shown in FIG. 2. In other embodiments the slurry apparatus 253 may be at least partially disassembled for relocation to a subsequent processing apparatus position.

A suitable mobile slurry apparatus is disclosed in commonly owned Canadian Patent Application No. 2,610,169 entitled "Method and Apparatus for Creating a Slurry."

In other embodiments, where the ore comprises minerals other than bitumen, the processing apparatus 116 may include various other processing stages, which may or may not produce a slurry of the sized ore.

Excavator and Comminutor

Figure 5:
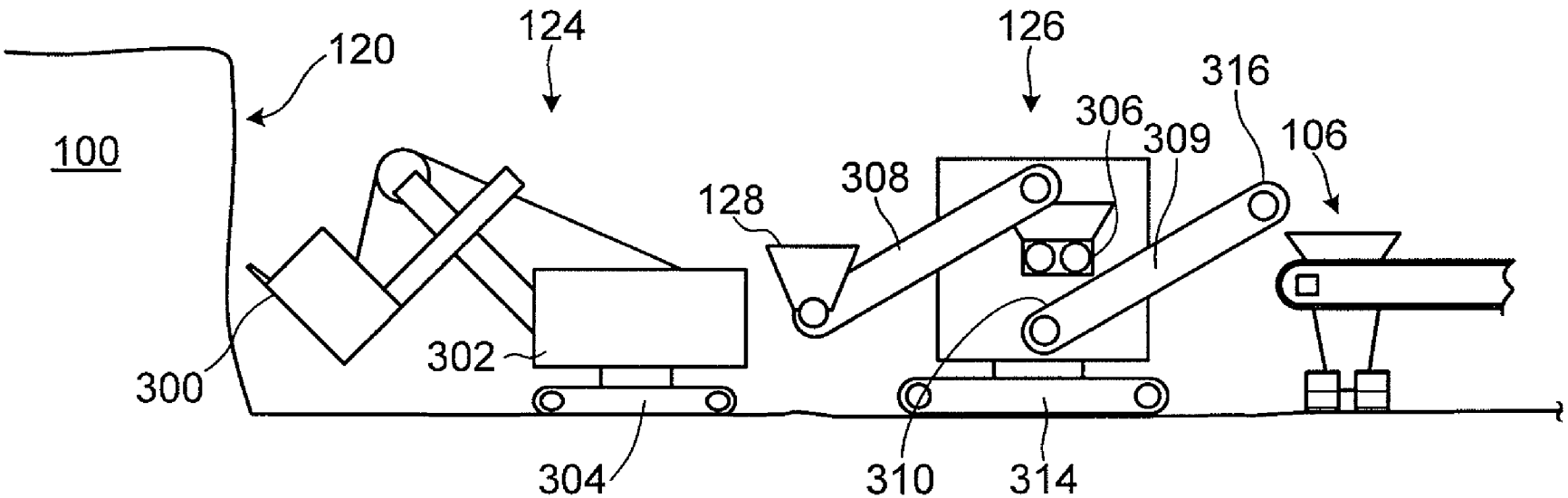
FIG. 5 is a side view of an excavator and a comminutor used in the process line apparatus shown in FIG. 1.

The excavator 124 and comminutor 126 are shown in side view in FIG. 5. In this embodiment the excavator 124 includes a front attached shovel 300 for excavating the mine face 120. The excavator 124 also includes a revolving deck 302 and is mounted for movement on tracks 304. The excavator 124 generally excavates ore from the mine face 120 using the shovel 300 and transfers the ore to a hopper 128 of the comminutor 126 by revolving the deck 302 and/or advancing the excavator 124 using the tracks 304. In other embodiments the excavator 124 may comprise a dragline or other excavator, for example.

The comminutor 126 includes a set of comminuting rollers 306 for comminuting or crushing the excavated ore to produce a sized ore feed that is suitable for conveying by the first and second mobile conveyors 104 and 110. In one embodiment the comminuting rollers 306 are sized and spaced to produce a sized ore feed having no chunks having a diameter of greater than about 350 mm. The comminutor 126 also includes an apron feeder 308 for conveying the excavated ore from the hopper 128 to the comminuting rollers 306. The comminutor 126 also includes a discharge conveyor 309, having a receiving end 310 and a discharge end 316. The sized ore feed is received from the comminuting rollers 306 at the receiving end 310, and is conveyed to the discharge end 316 where the sized ore is transferred to the receiving location 106 of the first mobile conveyor 104.

In general the comminutor 126 includes controls and sensors (not shown) for controlling the passage of ore from the apron feeder 308, through the comminuting rollers 306, and to the discharge conveyor 309. For example, various controls may be employed to slow down or speed up the apron feeder 308 and the discharge conveyor 309 to produce a generally even rate of sized ore feed to the first mobile conveyor 104. Sensors may also be employed to detect the occurrence of metal and/or large chunks, and to slow or halt the ore feed through the apparatus to appropriately deal with these occurrences. The comminutor 126 may also include a screen (not shown) ahead of the comminuting rollers 306 to reject oversize chunks of ore.

In an alternative embodiment, load carrying containers such as haul trucks (not shown) may be employed during at least some of the excavation operation. The load carrying container receives ore from the excavator 124 and transports the ore to the comminutor 126, thereby extending the operational reach of the excavator. However in general, it is desirable to limit the use of haul trucks by generally maintaining the excavator 124 and comminutor 126 within operational reach of each other to reduce overall excavation cost.

Mining Operations

As described above in connection with FIG. 2, the process for mining the ore deposit 100 involves excavating subsequent rectangular sections 156, 160, 164, 168, and 172 by moving the processing apparatus 116 to respective processing apparatus positions 154, 158, 162, 166, and 170. The excavation of each of the rectangular sections 156, 160, 164, 168, and 172 in accordance with one embodiment of the invention is described further with reference to FIGS. 6-12 showing operational stages for excavating the ore deposit.

First Operational Stage

Figure 6:
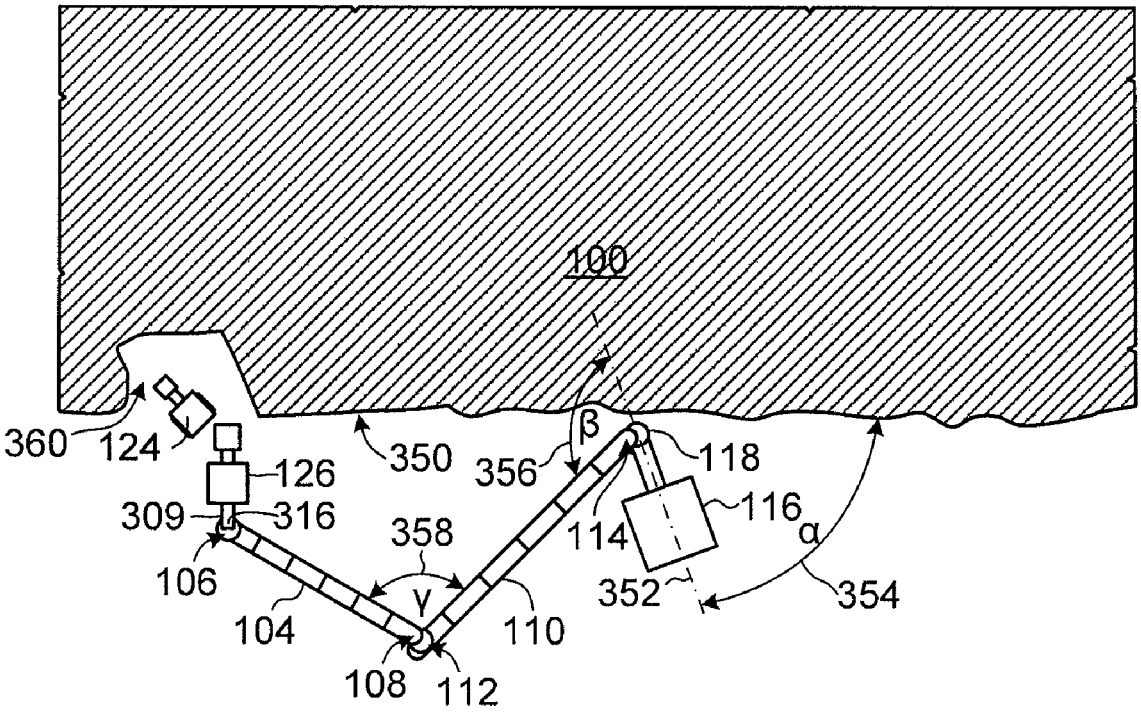
FIGS. 6-12 are a series of plan views of operational stages during excavation an ore deposit.

Referring to FIG. 6, in a first operational stage the processing apparatus 116 is located in a first processing apparatus position at a mine face 350 of an un-excavated section of the ore deposit 100. In this embodiment the processing apparatus 116 is generally centrally located with respect to the mine face 350 and the processing apparatus is oriented at an angle $\alpha$ between the mine face 350 and a longitudinal axis 352 of the processing apparatus, as shown at 354 in FIG. 6.

The second mobile conveyor 110 is positioned such that the discharge end 114 is over the hopper 118 of the processing apparatus 116, and the second mobile conveyor is oriented at an angle $\beta$ to the longitudinal axis 352 of the processing apparatus, as shown at 356. In general the angle $\beta$ is selected to provide operating clearance between the second mobile conveyor 104 and the processing apparatus 116 during mining operations. In one embodiment the angle $\beta$ is about 108°.

The first mobile conveyor 104 is positioned such that the discharge end 108 is proximate the transfer location 112, and the first mobile conveyor is oriented at an operational angle $\gamma$ between the length of the first mobile conveyor 104 and the length of the second mobile conveyor 110, as shown at 358 in FIG. 6. In the embodiment shown in FIG. 6 the transfer location 112 is located proximate a distal end of the second mobile conveyor 110 at a location furthest from the discharge end 114. However, as described above, the transfer location 112 may be moveable along the length of the second mobile conveyor 110 and may be located at any of a plurality of locations along the length of the second mobile conveyor.

The comminutor 126 is located such that the discharge end 316 of the discharge conveyor 309 is proximate the receiving location 106 of the first mobile conveyor 104. The orientation of the second mobile conveyor 110 (i.e., the angle $\beta$) and the operational angle $\gamma$ between the first and second mobile conveyors are selected to permit the excavator 124 to excavate the ore deposit 100 at a distal mine face portion 360.

In general, the bitumen containing ore deposit is covered by an overburden layer of sand, rock, and vegetation, which has little or no bitumen content. The overburden layer is typically removed in advance to prevent conveying ore to the processing apparatus 116 that does not carry any economic value. The overburden may be removed in its entirety prior to commencing excavation, or may be removed in sections ahead of the conveyor being advanced to permit excavation of the corresponding ore deposit section.

Figure 7:
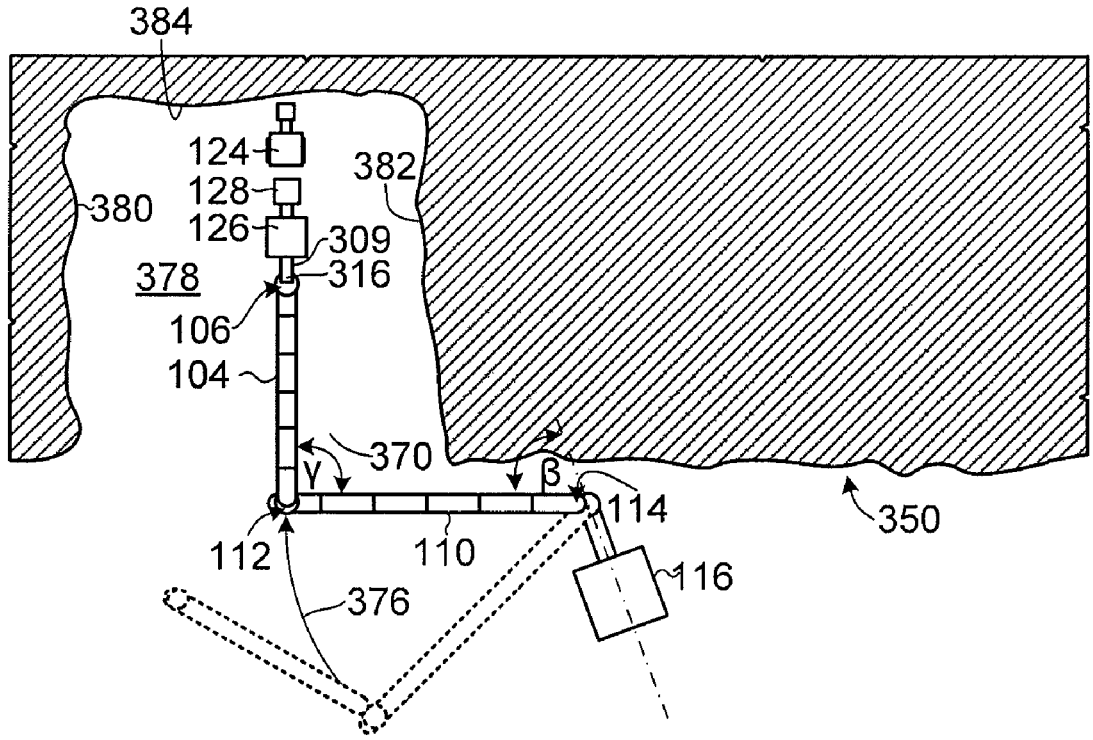

Referring to FIG. 7, in the first operational stage, the second mobile conveyor 110 is successively rotated about the discharge end 114 such that the transfer location 112 of the second mobile conveyor moves through an arc 376 towards the ore deposit 100. As the second mobile conveyor 110 is rotated the operational angle $\gamma$ between the first and second mobile conveyors is also successively varied to cause the receiving location 106 to advance while the excavator 124 extends the distal mine face portion 360 to expose a mine face 380. The comminutor 126 is also relocated to position the hopper 128 proximate a plurality of mine face locations along the mine face 380 while maintaining the discharge end 316 of the discharge conveyor 309 at the receiving location 106 of the first mobile conveyor 104.

In the embodiment shown in FIG. 7, on completion of the first operational stage a first portion 378 of the ore deposit 100 has been excavated and the second mobile conveyor 110 is oriented substantially parallel to the mine face 350 and the operational angle $\gamma$ between the first and second mobile conveyors 104 and 110 is approximately 90°. The first portion 378 is defined by a first exposed mine face 380, a second exposed mine face 382, and a third exposed mine face 384. In this embodiment the first and second exposed mine faces 380 and 382 are generally perpendicular to the length of said second mobile conveyor 110 and the third exposed mine face 384 is generally parallel to the length of said second mobile conveyor thus defining a generally rectangular excavated portion. However in other embodiments, the excavated portion may have an irregular shape.

Advantageously, by operating first and second mobile conveyors 104 and 110 at a varying operational angle γ, a generally linear portion of the mine face such as the mine face 380 may be excavated along a boundary such as the boundary 152 shown in FIG. 2, for example.

In other embodiments more than one spaced apart receiving locations (not shown) along the first mobile conveyor 104 may be simultaneously employed to further increase the excavation rate and the sized ore feed rate, if required.

Second Operational Stage

Figure 8:
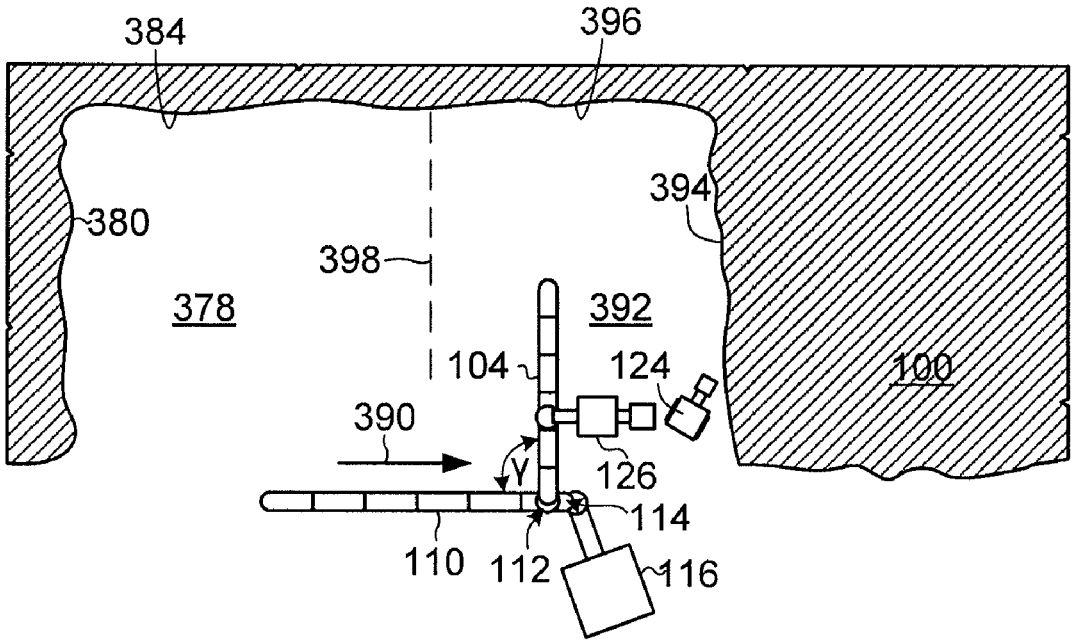

Referring to FIG. 8, in a second operational stage the processing apparatus 116 remains located at the first processing apparatus position. The first mobile conveyor 104 and the transfer location 112 are successively translated in a lateral direction indicated by the arrow 390, while the angle γ between the first and second mobile conveyors is maintained substantially constant (in this embodiment at an angle of about 90°). Following each successive lateral translation, excavation occurs at a second plurality of mine faces to define a second portion 392. On completion of the second operational stage, the transfer location 112 is located proximate the discharge end 114 of the second mobile conveyor 110. The second portion 392 is generally defined by extending the third exposed mine face 384 to expose a fourth exposed mine face 396, and by exposing a fifth mine face 394. In this embodiment the first and second portions 378 and 392 are contiguously located rectangular portions and share a common boundary 398 (shown as a broken line) generally defined by the previously exposed mine face 382.

Third Operational Stage

Figure 9:
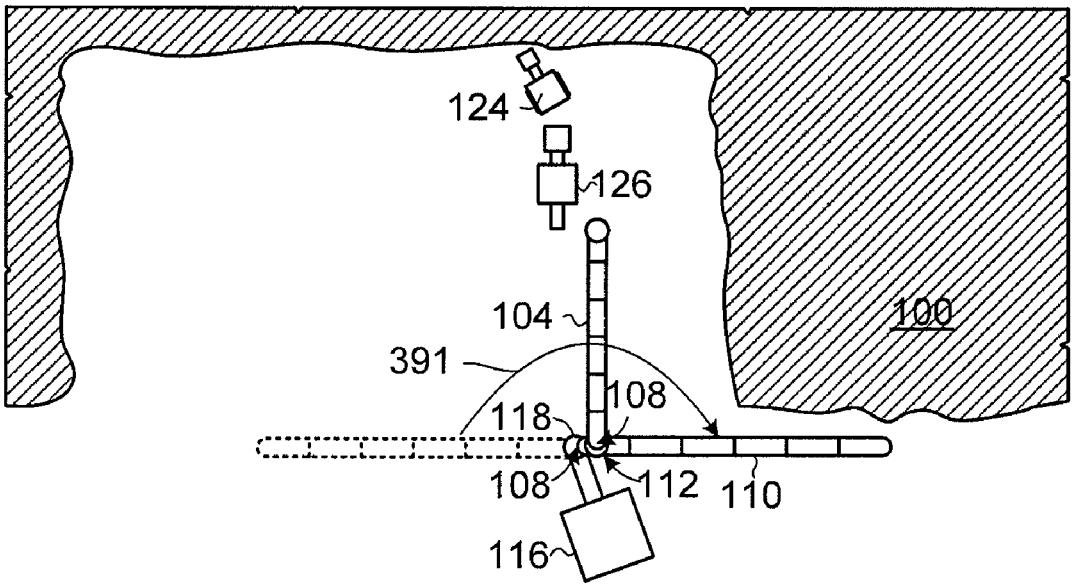

Referring to FIG. 9, in a third operational stage the processing apparatus 116 again remains at the first processing apparatus position. The second mobile conveyor 110 is then rotated about the discharge end 108 to swing through an arc of about 180°. Alternatively, individual conveyor sections may be detached from each other, swung through 180° and then re-attached to reconfigure the second mobile conveyor 110 for conveying in an opposite direction. Conveyor modules such as those described above in connection with FIG. 3 are not generally configured for bi-directional conveying.

The first mobile conveyor 104 may need to be moved to permit the rotation of the second mobile conveyor, whereafter the first mobile conveyor is then moved to place the discharge end 108 at the transfer location 112, which is initially located proximate the discharge end 108. Alternatively, if permitted by the terrain, the second mobile conveyor may be moved away from the processing apparatus 116 for rotating, thereby permitting excavation to continue using the first mobile conveyor 104. In this case the discharge end 108 of the first mobile conveyor 104 is located to discharge sized ore directly into the hopper 118 of the processing apparatus 116. When the second mobile conveyor 110 has been reconfigured, it may be moved back into operation as shown in FIG. 9.

Figure 10:
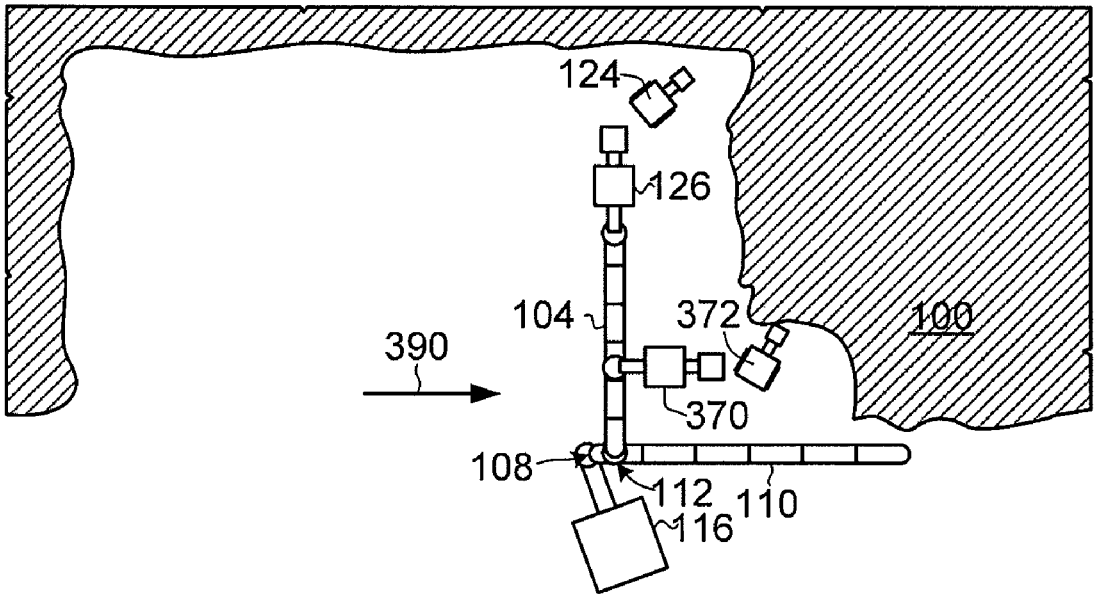
Figure 11:
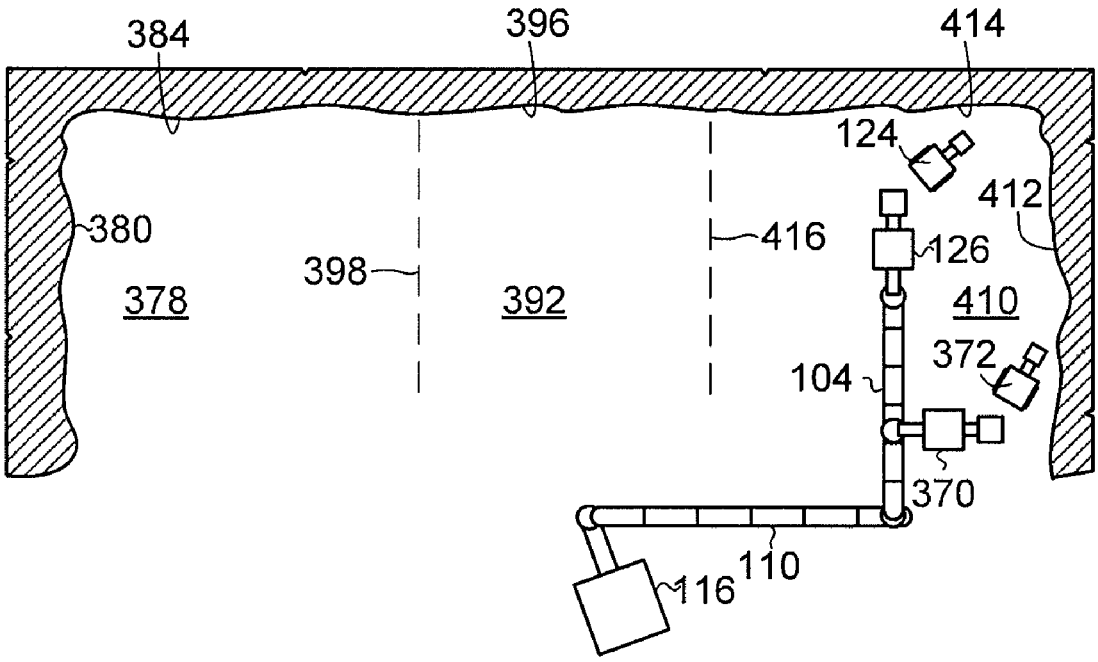

Referring to FIG. 10, in the third operational stage sized ore received at the transfer location 112 is conveyed to the discharge end 108. As described above in connection with FIGS. 7 and 8 the first mobile conveyor 104 and the transfer location 112 are again successively translated in a lateral direction indicated by the arrow 390, while the angle γ between the first and second mobile conveyors maintained substantially constant. Referring to FIG. 11, following each successive lateral translation, excavation occurs at a third plurality of mine faces to define a third portion 410. The third portion 410 is generally defined by extending the fourth exposed mine face 396 to expose a sixth exposed mine face 414, and by exposing a seventh mine face 412. In this embodiment the second and third portions 392 and 410 are contiguously located rectangular portions and share a common boundary 416 (shown as a broken line) generally defined by the previously exposed mine face 394.

Figure 12:
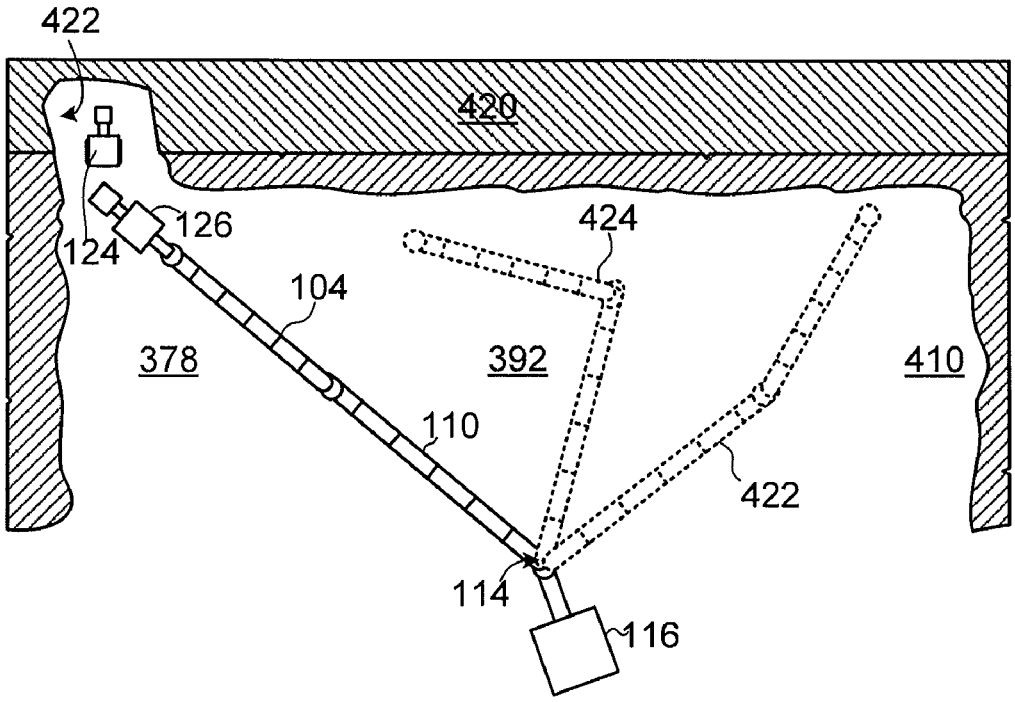

Referring to FIG. 12, an alternative operational embodiment may include a fourth operation stage following completion of the third operational stage. In the fourth operational stage the first and second mobile conveyors 104 and 110 are disposed substantially in-line with each other to permit the sized ore feed to be received at a mine face 422 proximate a distally located corner of the section comprising portions 378, 392, and 410.

Advantageously, excavation of the first, second, and third portions 378, 392, and 410 as described above results in an extensive section of the ore deposit 100 being excavated while the processing apparatus 116 remains located in the first processing apparatus position. By moving both the first and second mobile conveyors 104 and 110, the process line 102 facilitates excavation of linear walls along the mine face and/or excavation of substantially rectangular sections of ore.

In one embodiment the first mobile conveyor may be about 240 meters in length and the second mobile conveyor may be about 200 meters in length, which facilitates excavation of a section having a mine face of about 710 meters wide and extending about 270 meters into the mine face (i.e., in a direction away from the processing apparatus position).

Figure 13:
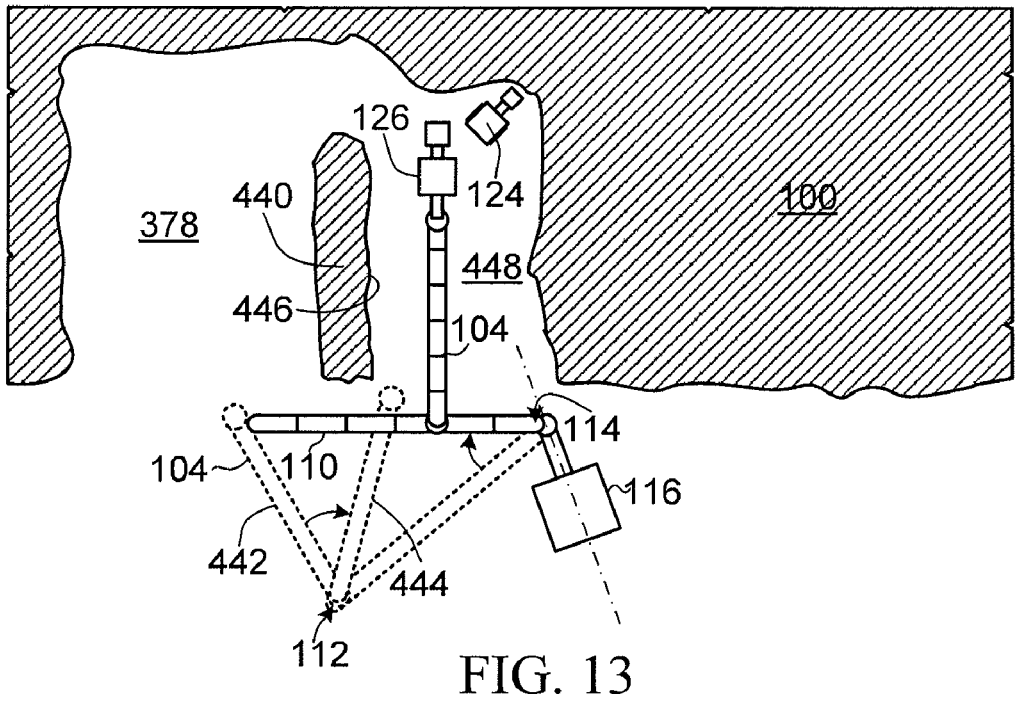
FIG. 13 is a plan view of an operational stage during excavating an ore deposit in accordance with an alternative embodiment of the invention.

Referring to FIG. 13, in another operational embodiment the first and second mobile conveyors 104 and 110 may be operated to move around a portion 440 of the ore deposit 100 that is not to be excavated. The portion 440 may include low grade ore having a bitumen content that is lower than a minimum content for economical processing. Alternatively, the portion 440 may comprise a hard rock outcrop, or other obstacle around which it is desired to excavate the ore while leaving the obstacle substantially intact.

Referring back to FIG. 7, once the portion 378 has been excavated and it has been determined that at least a portion of the mine face 382 should not be excavated, the second mobile conveyor 110 is rotated about the discharge end 114 away from the mine face 350. In this embodiment the first mobile conveyor 104 is moved to follow the second mobile conveyor 110, such that the conveyors return to the general location shown in broken outline in FIG. 7. In general, the degree of rotation of the second mobile conveyor 110 away from the mine face 350 should be sufficient to permit the first mobile conveyor 104 to clear the mine face 350.

Referring back to FIG. 13, the first mobile conveyor 104 is then rotated about the transfer location 112 as shown in broken outline at 442.

During these movements of the first and second mobile conveyors 104 and 110, receiving of the sized ore may be temporarily suspended until the respective conveyors are repositioned. At this time the excavator 124 and comminutor 126 may be moved into position for continuing excavation along a mine face 446 of the portion 440. Operations then generally continue as described above and excavation continues along the generally linear mine face 446 and a further portion 448 is excavated while leaving the portion 440 unexcavated.

Advantageously, using first and second mobile conveyors 104 and 110 configurable at the varying angle γ facilitates mining around the portion 140. Prior art process lines would require the portion 440 to be excavated and removed to permit the conveyor to pass in its operational arc. Furthermore, by permitting the portion 440 to remain unexcavated, it is not necessary to remove the overburden above the portion 440. Removal of overburden represents an un-recoverable cost in excavating an ore deposit since the overburden has little or no economic value. Furthermore removing the need to process low grade ore advantageously increases the proportion of bitumen containing ore in the total volume of ore that is excavated, thereby improving operational efficiency.

While specific embodiments of the invention have been described and illustrated, such embodiments should be considered illustrative of the invention only and not as limiting the invention as construed in accordance with the accompanying claims.

What is claimed is:

1. A method for processing a sized ore feed excavated from an ore deposit, the method comprising:

disposing a processing apparatus in a processing apparatus position relative to the ore deposit;

disposing a first mobile conveyor to receive a sized ore feed at a receiving location located along a length of said first mobile conveyor, said first mobile conveyor being operable to convey the sized ore from said receiving location to a discharge end of said first mobile conveyor;

disposing a second mobile conveyor to receive the sized ore from said discharge end of said first mobile conveyor at a transfer location along a length of said second mobile conveyor and to convey the sized ore from said transfer location to said processing apparatus, said first and second mobile conveyors being oriented at an operational angle between said length of said first mobile conveyor and said length of said second mobile conveyor; and moving at least one of said first and second mobile conveyors to vary at least one of said operational angle and said transfer location wherein moving said at least one of first and second mobile conveyors comprises:

(a) in a first type of movement, causing the operational angle between the first and second mobile conveyors to be varied while the transfer location is maintained substantially constant, (b) in a second type of movement, causing the transfer location to be varied while the operational angle between the first and second mobile conveyors is maintained substantially constant, and (c) in a third type of movement, causing both the transfer location and the operational angle to be varied, to permit successive portions of the ore deposit within operational reach of said receiving location to be received for conveying along said first and second mobile conveyors to said processing apparatus while said processing apparatus is located in said processing apparatus position.

2. The method of claim 1 wherein the ore deposit comprises at least one portion within operational reach of said receiving location that is not to be excavated and wherein moving said at least one of said first and second mobile conveyors comprises varying at least one of said operational angle and said transfer location to move said receiving location around said at least one portion that is not to be excavated.

3. The method of claim 1 wherein receiving the sized ore feed at said receiving location comprises receiving the sized ore feed proximate at least one of a plurality of receiving locations along said length of said first mobile conveyor.

4. The method of claim 3 wherein receiving the sized ore feed at said at least one of said plurality of receiving locations comprises receiving the sized ore feed at a hopper mounted for movement on a track extending along at least a portion of said length of said first mobile conveyor.

5. The method of any one of claims 1 to 3 wherein receiving said sized ore feed comprises receiving ore from an excavator and comminuting the ore to produce said sized ore feed.

6. The method of claim 5 wherein receiving said ore from said excavator comprises receiving said ore in a load carrying container and transporting said ore to a comminutor for comminuting the ore.

7. The method of claim 1 wherein disposing said processing apparatus comprises disposing said processing apparatus at an angle to a mine face of the ore deposit to provide clearance between said second mobile conveyor and said processing apparatus when moving said second mobile conveyor.

8. The method of claim 1 wherein in a first operational stage:

disposing said first mobile conveyor comprises disposing said first mobile conveyor to position said receiving location of said first mobile conveyor at a distal mine face location with respect to said processing apparatus position;

disposing said second mobile conveyor comprises causing said second mobile conveyor to be disposed to discharge the sized ore into a feeder of the processing apparatus; and wherein moving at least one of said first and second mobile conveyors comprises causing said second mobile conveyor to successively move toward the mine face about said feeder while causing said first mobile conveyor to progressively advance into the ore deposit while excavating a first portion of the ore deposit within operational reach of said receiving location.

9. The method of claim 8 wherein disposing said second mobile conveyor to receive the sized ore from said discharge end of said first mobile conveyor comprises disposing said second mobile conveyor to receive the sized ore at a transfer location proximate an end of said second mobile conveyor that is distally located with respect to the discharge end of said second mobile conveyor.

10. The method of claim 8 wherein in a second operational stage:

disposing said second mobile conveyor comprises causing said second mobile conveyor to be disposed generally parallel to the mine face; and wherein moving said at least one of said first and second mobile conveyors comprises causing said first mobile conveyor to be laterally translated while successively moving said transfer location along said second mobile conveyor toward said feeder of said processing apparatus while maintaining said operational angle substantially constant to permit excavation of a second portion of the ore deposit within operational reach of said receiving location.

11. The method of claim 10 wherein maintaining said operational angle substantially constant comprises maintaining an operational angle of about 90 degrees.

12. The method of claim 10 wherein in a third operational stage:

disposing said second mobile conveyor comprises causing said second mobile conveyor to be moved to position said transfer location on an opposite side of said feeder of said processing apparatus; and wherein moving said at least one of said first and second mobile conveyors comprises:

moving said first mobile conveyor to place said discharge end of said first mobile conveyor at said transfer location; and causing said first mobile conveyor to be laterally translated while successively moving said transfer location along said second mobile conveyor away from said feeder of said processing apparatus while maintaining said operational angle substantially constant to permit excavation of a third portion of the ore deposit within operational reach of said receiving location.

13. The method of claim 12 wherein in a fourth operational stage:

moving said at least one of said first and second mobile conveyors comprises causing said first and second mobile conveyors to be disposed at an operational angle of about 180 degrees such that the first and second mobile conveyors are generally in-line with each other to permit excavation of distally located portions of the ore deposit within operational reach of said receiving location.

14. The method of claim 1 wherein moving at least one of said first and second mobile conveyors comprises moving both said first mobile conveyor and said second mobile conveyor while varying said operational angle to permit excavation along a generally linear mine face portion of the ore deposit.

15. The method of any one of claims 1, 10 and 12, wherein said processing apparatus position comprises a first processing apparatus position and further comprising, on completion of excavation of said successive portions of the ore deposit within operational reach of said receiving location, relocating said processing apparatus to a second processing apparatus position to permit excavation of further portions of the ore deposit while said processing apparatus is located in said second processing apparatus position.

16. The method of claim 1 wherein:

(a) said first type of movement comprises rotation of said first mobile conveyor generally about said transfer location;

(b) said second type of movement comprises lateral translation of said first mobile conveyor and said transfer location along said second mobile conveyor; and (c) said third type of movement comprises rotation of said first mobile conveyor generally about said transfer location combined with lateral translation of said first mobile conveyor and transfer location along said second mobile conveyor.

17. The method of claim 1 wherein:

(a) said first type of movement comprises rotation of said first mobile conveyor generally about said transfer location;

(b) said second type of movement comprises rotation of said transfer location generally about an ore-receiving intake of said processing apparatus; and (c) said third type of movement comprises rotation of said first mobile conveyor generally about said transfer location combined with rotation of said transfer location generally about said ore-receiving intake.

18. The method of claim 1 further comprising varying said operational angle at least between about 90 degrees and about 180 degrees.

19. The method of claim 1 wherein said processing apparatus comprises an apparatus for producing a slurry.

20. A method for processing a sized ore feed excavated from an ore deposit, the method comprising:

disposing a processing apparatus in a first processing apparatus position relative to the ore deposit;

disposing a first mobile conveyor to receive a sized ore feed at a receiving location located along a length of said first mobile conveyor, said first mobile conveyor being operable to convey the sized ore from said receiving location to a discharge end of said first mobile conveyor;

disposing a second mobile conveyor to receive the sized ore from said discharge end of said first mobile conveyor at a transfer location disposed along a length of said second mobile conveyor and to convey the sized ore from said transfer location along said second mobile conveyor to a discharge end of said second mobile conveyor aligned to convey the sized ore to an intake of said processing apparatus, said first and second mobile conveyors being oriented at an operational angle between said length of said first mobile conveyor and said length of said second mobile conveyor; and excavating in a generally straight line along a generally linear mine face wherein excavating comprises advancing said receiving location along said generally straight line by a combination of:

(a) causing said second mobile conveyor and said transfer location to rotate generally about said intake of said processing apparatus while maintaining alignment of said discharge end of said second mobile conveyor with said intake; and (b) causing said first mobile conveyor to rotate about said transfer location on said second mobile conveyor to vary said operational angle while maintaining alignment of said discharge end of said first mobile conveyor with said transfer location on said second mobile conveyor;

to permit successive portions of the ore deposit within operational reach of said receiving location as it advances along said generally linear mine face to be received for conveyance along said first and second mobile conveyors to said processing apparatus while said processing apparatus is located in said processing apparatus position.

21. The method of claim 20 further comprising:

in response to a determination that at least a portion of a particular mine face portion should not be excavated:

causing the second mobile conveyor to rotate about its discharge end away from the particular mine face; and causing the first mobile conveyor to move to follow the second mobile conveyor while causing the first mobile conveyor to rotate about said transfer location so as to:

(i) decrease the operational angle sufficiently to permit the first mobile conveyor to clear the particular mine face; and (ii) place the first mobile conveyor into a position from which it can advance in cooperation with the second mobile conveyor to facilitate mining of a different mine face portion, spaced apart from said particular mine face portion.

22. The method of claim 21 further comprising temporarily suspending receiving of the sized ore while the first and second mobile conveyors are repositioning.

23. The method of claim 22 further comprising moving said receiving location along said different mine face portion in a generally straight line, wherein the generally straight line is not parallel to the second mobile mining conveyor.

24. The method of claim 20 wherein said processing apparatus comprises a mobile slurry apparatus.

25. A method for processing a sized ore feed excavated from an ore deposit, the method comprising:

disposing a processing apparatus in a processing apparatus position relative to the ore deposit;

disposing a first mobile conveyor to receive a sized ore feed at a receiving location located along a length of said first mobile conveyor, said first mobile conveyor being operable to convey the sized ore from said receiving location to a discharge end of said first mobile conveyor;

disposing a second mobile conveyor to receive the sized ore from said discharge end of said first mobile conveyor at a transfer location along a length of said second mobile conveyor and to convey the sized ore from said transfer location to said processing apparatus, said first and second mobile conveyors being oriented at an operational angle between said length of said first mobile conveyor and said length of said second mobile conveyor; and moving said first mobile conveyor and said second mobile conveyor to vary said operational angle and said transfer location by:

(a) rotating said first mobile conveyor about said discharge end of said first mobile conveyor such that the operational angle between said first and second mobile conveyors is varied while the transfer location is maintained substantially constant, (b) rotating said second mobile conveyor generally about an ore-receiving intake of said processing apparatus such that said transfer location is moved in an arc while maintaining alignment of said second mobile conveyor with said ore-receiving intake of said processing apparatus, and (c) laterally translating said first mobile conveyor along said second mobile conveyor such that the transfer location along said second mobile conveyor is laterally translated while said operational angle between the first and second mobile conveyors is maintained substantially constant, to permit successive portions of the ore deposit within operational reach of said receiving location to be to be excavated and received for conveying along the first and second mobile conveyors to said processing apparatus while said processing apparatus is located in said processing apparatus position.

26. The method of claim 25 wherein the ore deposit comprises at least one portion within operational reach of said receiving location that is not to be excavated and wherein the method further comprises moving said first and second mobile conveyors to vary at least one of said operational angle and said transfer location to move said receiving location around said at least one portion that is not to be excavated.

27. The method of claim 25 wherein said receiving location comprises at least one of a plurality of receiving locations along said length of said first mobile conveyor.

28. The method of claim 27 further comprising receiving the sized ore feed at a hopper mounted for movement on a track extending along at least a portion of said length of said first mobile conveyor.

29. The method of claim 25 further comprising:

excavating ore from the ore deposit using an excavator; and receiving excavated ore from the excavator at a comminutor and comminuting the ore to produce said sized ore feed.

30. The method of claim 29 further comprising transporting said ore between said excavator and said comminutor using a plurality of load carrying containers.

31. The method of claim 25 wherein moving said first mobile conveyor and said second mobile conveyor to vary said operational angle and said transfer location comprises moving said receiving location along a linear mine face in a generally straight line, wherein the generally straight line is not parallel to the second mobile mining conveyor.

32. The method of claim 25 further comprising, upon completion of excavation of said successive portions of the ore deposit within operational reach of said receiving location while said processing apparatus is located in said processing apparatus position, relocating said processing apparatus to a subsequent processing apparatus position, and relocating the first and second mobile conveyors to cooperate to convey excavated ore to the subsequent processing apparatus position, to permit excavation of further portions of the ore deposit within operational reach while said processing apparatus is located at the subsequent processing apparatus position.

33. The method of claim 25 wherein said processing apparatus comprises a mobile slurry apparatus.

* * * * *

UNITED STATES PATENT AND TRADEMARK OFFICE

CERTIFICATE OF CORRECTION

PATENT NO. : 8,317,116 B2
APPLICATION NO. : 12/242642
DATED : November 27, 2012
INVENTOR(S) : Dirk et al.

It is certified that error appears in the above-identified patent and that said Letters Patent is hereby corrected as shown below:

On the Title Page of the patent, under (63) Related U.S. Application Data, please insert item (30), --Foreign Application Priority Data, Nov. 9, 2005 (CA).....2526336, Nov. 9, 2006 (CA).....2567644--.

In the Specifications:

In column 4 at line 13, Change "to be to be" to --to be--.

In column 6 at line 17, Change "to be to be" to --to be--.

In the Claims:

In column 13 at line 22, In Claim 1, after "location" insert --selected from a plurality of transfer locations available--.

In column 16 at line 1, In Claim 20, after "disposed" insert --at one of a plurality of transfer locations available--.

In column 16 at line 53, In Claim 23, after "in a" insert --second--.

In column 16 at line 53, In Claim 23, after "wherein the" insert --second--.

In column 17 at line 30, In Claim 25, change "to be to be" to --to be--.

Signed and Sealed this
Second Day of July, 2013

Teresa Stanek Rea

Teresa Stanek Rea
*Acting Director of the United States Patent and Trademark Office*